US009599346B2

(12) United States Patent
Lu

(10) Patent No.: US 9,599,346 B2
(45) Date of Patent: Mar. 21, 2017

(54) NETWORK CONTROL ELECTRIC FIREPLACE

(71) Applicant: DONG GUAN SONG WEI ELECTRIC TECHNOLOGY CO., LTD, Dongguan (CN)

(72) Inventor: Weilin Lu, Dongguan (CN)

(73) Assignee: DONG GUAN SONG WEI ELECTRIC TECHNOLOGY CO., LTD., Dongguan, Guangdong Province (CN)

( * ) Notice: Subject to any disclaimer, the term of this patent is extended or adjusted under 35 U.S.C. 154(b) by 208 days.

(21) Appl. No.: 14/569,647

(22) Filed: Dec. 13, 2014

(65) Prior Publication Data

US 2016/0169528 A1 Jun. 16, 2016

(51) Int. Cl.

| | |
|---|---|
| ***F24B 1/18*** | (2006.01) |
| ***F24C 7/00*** | (2006.01) |
| ***F24D 13/00*** | (2006.01) |

(52) U.S. Cl.

CPC ..... *F24C 7/004* (2013.01); *F24D 13/00* (2013.01); *F24B 1/1808* (2013.01)

(58) Field of Classification Search

None

See application file for complete search history.

(56) References Cited

U.S. PATENT DOCUMENTS

| | | | | | |
|---|---|---|---|---|---|
| 4,253,045 | A * | 2/1981 | Weber | H05B 37/029 | 315/209 R |
| 4,965,707 | A * | 10/1990 | Butterfield | F24C 7/004 | 362/806 |
| 5,642,580 | A * | 7/1997 | Hess | F21S 10/04 | 40/428 |
| 5,983,890 | A * | 11/1999 | Thomas | F24B 1/1808 | 126/508 |
| 6,393,207 | B1 * | 5/2002 | Martin | F24C 7/004 | 362/806 |
| 6,757,487 | B2 * | 6/2004 | Martin | F24C 7/004 | 362/806 |
| 7,770,312 | B2 * | 8/2010 | Stinson | F24C 7/004 | 40/428 |
| 7,826,727 | B2 * | 11/2010 | Bourne | F24C 7/004 | 392/407 |
| 8,249,731 | B2 * | 8/2012 | Tran | A61B 5/002 | 222/23 |

(Continued)

*Primary Examiner* — Thor Campbell

(74) *Attorney, Agent, or Firm* — Leong C. Lei

(57) ABSTRACT

A network control electric fireplace includes a housing, an image screen in the housing, an imitation charcoal, an illuminating device, a flame processing device, a light reflection device, an image light source, a heater, and a control device. The light reflection device includes a light reflection assembly and a motor. The control device is used to receive the network control command sent from the electronic apparatus. The heater, the illuminating device, the motor, and the image light source are connected with the control device, such that each function of the electric fireplace can be achieved by the network control. In winter, the user can turn on the heater through network control to warm up the indoor in advance, such that he/she can feel warm air indoors. It is not required to operate the operation panel on the electric fireplace. It is convenient to operate and use the present invention.

8 Claims, 2 Drawing Sheets

(56) References Cited

U.S. PATENT DOCUMENTS 8,250,792 B2 * 8/2012 Zhu ..... F24C 7/004 40/428
8,739,439 B2 * 6/2014 Asofsky ..... F24C 7/004 40/428
2002/0168182 A1 * 11/2002 Martin ..... F24C 7/004 392/348
2005/0097792 A1 * 5/2005 Naden ..... F24C 7/004 40/428
2005/0208443 A1 * 9/2005 Bachinski ..... F23D 14/84 431/8
2007/0084942 A1 * 4/2007 Moore ..... F02G 1/043 237/19
2007/0198671 A1 * 8/2007 Motoyama ..... G08C 17/02 709/222
2007/0235020 A1 * 10/2007 Hills ..... F23N 1/002 126/512
2007/0292810 A1 * 12/2007 Maiello ..... F23N 1/002 431/59
2011/0090042 A1 * 4/2011 Leonard ..... G05B 15/02 340/5.1
2012/0050064 A1 * 3/2012 Husney ..... H04L 12/2827 340/870.02
2013/0024029 A1 * 1/2013 Tran ..... A61B 5/1113 700/278
2013/0074382 A1 * 3/2013 Lu ..... F21S 10/04 40/428
2013/0077287 A1 * 3/2013 Lu ..... F24C 7/004 362/92
2013/0213952 A1 * 8/2013 Boutin ..... G05D 23/1905 219/494
2014/0084682 A1 * 3/2014 Covic ..... H02J 3/14 307/17
2014/0324244 A1 * 10/2014 Musunuri ..... G05B 15/02 700/299
2015/0204561 A1 * 7/2015 Sadwick ..... F24F 11/006 236/1 C
2015/0276269 A1 * 10/2015 Paolini ..... F24H 9/2071 392/365
2015/0338105 A1 * 11/2015 Lu ..... F24C 7/004 40/428
2015/0350008 A1 * 12/2015 Kim ..... H04L 47/41 709/221
2016/0169537 A1 * 6/2016 Lu ..... F24D 13/00 422/123
2016/0226732 A1 * 8/2016 Kim ..... H04L 12/24

* cited by examiner

NETWORK CONTROL ELECTRIC FIREPLACE

BACKGROUND OF THE INVENTION

1. Field of the Invention

The present invention relates to an electric fireplace, and more particularly to a network control electric fireplace.

2. Description of the Prior Art

In the early days, a fireplace can be used for lighting, warming, baking. With the development of economy and technology, the three functions of lighting, warming, baking are gradually improved and separated. These days, a fireplace becomes warming equipment.

With the development of times, fireplaces are improved from the traditional fireplaces, such as wood burning fireplaces, fuel gas fireplaces or charcoal fireplaces, to electric fireplaces. The electric fireplaces come from the European classical fireplaces to cooperate with acoustics and optics technique to make a great change for the traditional fireplaces. The electric fireplaces are green and friendly-environmental and provide a realistic burning effect.

In these days, electric fireplaces are rapidly developed to substitute the traditional fireplaces. A conventional electric fireplace is provided with an illuminating device to radiate light. The light is reflected to form flame-shaped light to be projected on an image screen. The existing electric fireplace is provided with a heater to rise the indoor temperature. However, the existing electric fireplace is operated manually through the control panel for controlling each function of the electric fireplace. It is inconvenient for operation and use. Accordingly, the inventor of the present invention has devoted himself based on his many years of practical experiences to solve this problem.

SUMMARY OF THE INVENTION

The primary objective of the present invention is to provide a network control electric fireplace to overcome the shortcomings of the existing electric fireplaces.

In order to achieve the aforesaid object, the network control electric fireplace of the present invention comprises a housing, an image screen disposed in the housing, an imitation charcoal, an illuminating device, a flame processing device, a light reflection device, an image light source, a heater, and a control device for receiving a network control command sent from an electronic apparatus. The housing has a transparent front door at a front side thereof. The housing has an image window therein. The image screen is disposed at the image window and located behind the front door. An accommodation space is defined between the image screen and the front door. The imitation charcoal is located in the accommodation space. The illumination device is located under the imitation charcoal. The flame processing device is located behind the image screen. The light reflection device is located behind the flame processing device. The light reflection device comprises a light reflection assembly and a motor. The motor brings the light reflection assembly to rotate. The image light source is disposed under the light reflection assembly. The heater is disposed in the housing. The housing has a hot wind outlet. The heater has an air outlet communicating with the hot wind outlet of the housing. The heater, the illuminating device, the motor, and the image light source are connected with the control device.

Compared to the prior art, the present invention has obvious advantages and beneficial effects. The control device is used to receive the network control command sent from the electronic apparatus. All the heater, the illuminating device, the motor, and the image light source are connected with the control device, such that each function of the electric fireplace can be achieved by network control. In winter, the user can turn on the heater through the network control to warm up the indoor in advance, such that he/she can feel warm air indoors. It is not required to operate the operation panel on the electric fireplace. It is very convenient to operate and use the present invention.

DETAILED DESCRIPTION OF THE PREFERRED EMBODIMENTS

Embodiments of the present invention will now be described, by way of example only, with reference to the accompanying drawings.

Figure 1:
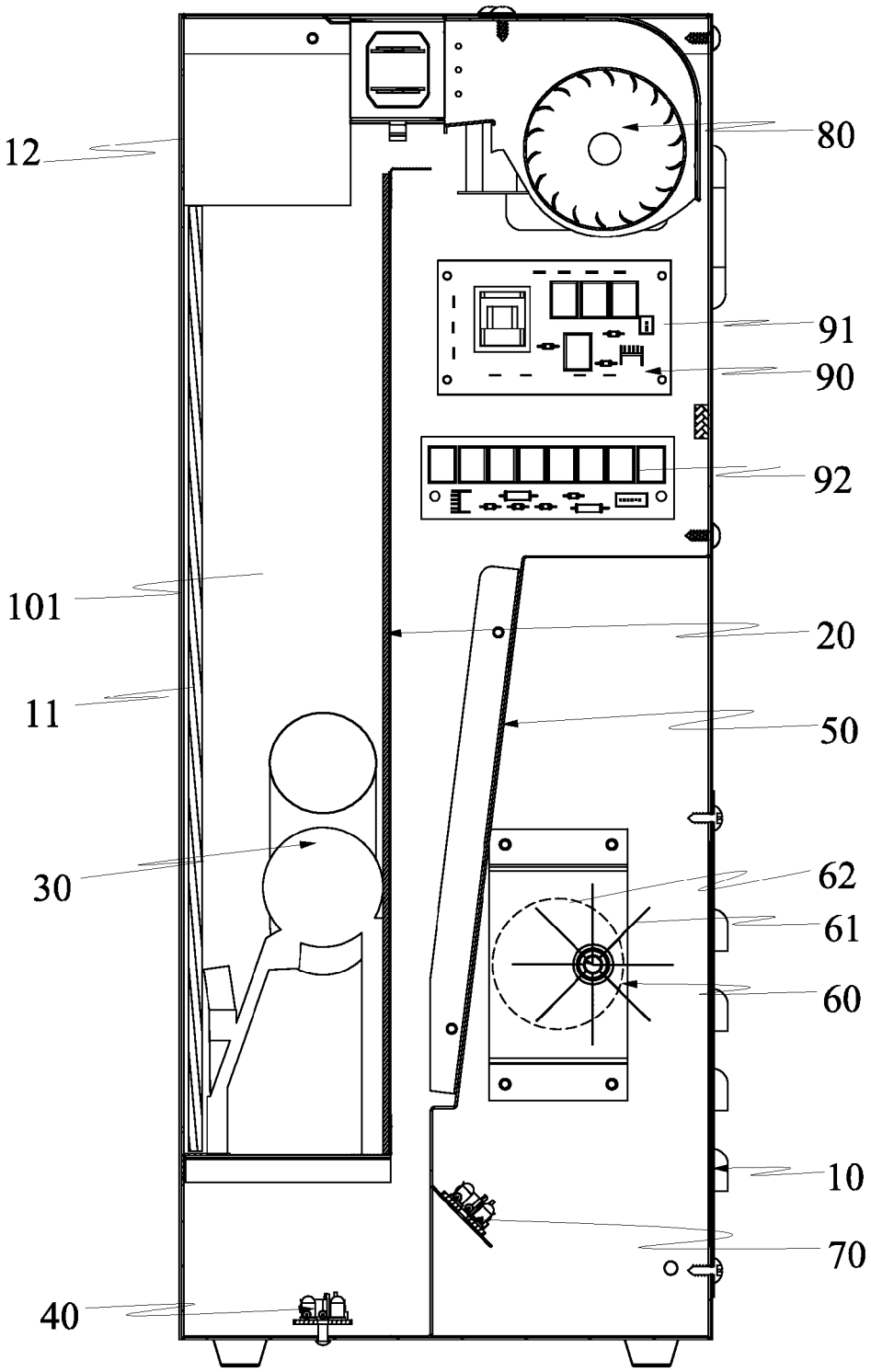
FIG. 1 is a sectional view according to a preferred embodiment of the present invention.
Figure 2:
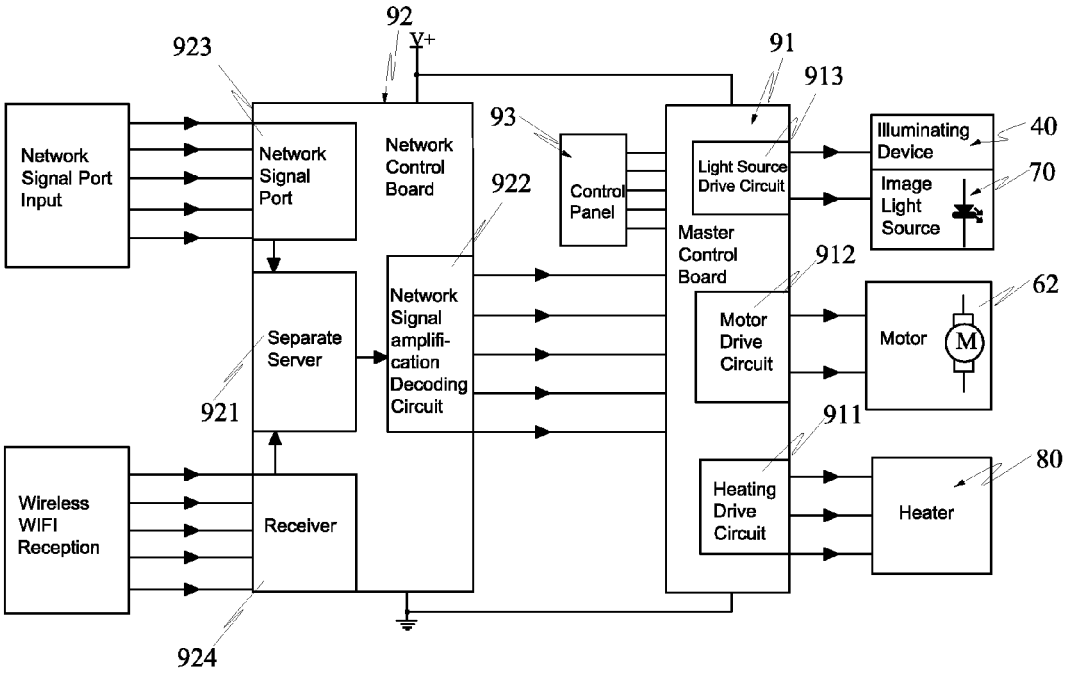
FIG. 2 is a block diagram showing the circuit of the preferred embodiment of the present invention.

As shown in FIG. 1 and FIG. 2, the network control electric fireplace according to a preferred embodiment of the present invention comprises a housing 10, an image screen 20 disposed in the housing 10, an imitation charcoal 30, an illuminating device 40, a flame processing device 50, a light reflection device 60, an image light source 70, a heater 80, and a control device 90.

The housing 10 has a transparent front door 11 at a front side thereof. The front door 11 is a glass door or a meshed door. The housing 10 has an image window therein. The image screen 20 is disposed at the image window and located behind the front door 11. An accommodation space 101 is defined between the image screen 20 and the front door 11.

The imitation charcoal 30 is located in the accommodation space 101. The illumination device 40 is located under the imitation charcoal 30. The illumination device 40 is an LED illuminating device.

The flame processing device 50 is located behind the image screen 20. Specifically, the flame processing device 50 is a flame plate. The flame plate is formed with a plurality of flame holes (not shown in the drawings). The light reflection device 60 is located behind the flame processing device 50. The light reflection device 60 comprises a light reflection assembly 61 and a motor 62. The motor 62 brings the light reflection assembly to rotate. The motor 62 is a stepper motor, a synchronous motor or a direct current motor. The image light source 70 is disposed under the light reflection assembly 61. The image light source 70 is an LED image light source.

The heater 80 is disposed in the housing 10. In this embodiment, the heater 80 is located at the top portion of the housing 10. The housing 10 has a hot wind outlet 12. The hot wind outlet 12 is located at the upper front side of the housing 10. The heater 80 has an air outlet communicating with the hot wind outlet 12 of the housing 10.

The control device 90 is used to receive network control commands sent from an electronic apparatus. The electronic apparatus is a cell phone, a computer, an iPad or the like which is a smart electronic apparatus capable of internet access. The heater 80, the illuminating device 40, the motor 62, and the image light source 70 are all connected with the control device 90. In this embodiment, the control device 90 comprises a master control board 91 and a network control board 92. The master control board 91 and the network control board 92 are installed at the rear interior of the housing 10 or at an upper cover of the housing 10. As shown in FIG. 2, the master control board 91 has a heating drive circuit 911, a motor drive circuit 912, and a light source drive circuit 913. The heating drive circuit 911 is connected with the heater 80. The motor drive circuit 912 is connected with the motor 62. The light source drive circuit 913 is connected with the illuminating device 40 and the image light source 70. The network control board 92 has a separate server 921 and a network signal amplification decoding circuit 922. The separate server 921 is connected with the network signal amplification decoding circuit 922. The network signal amplification decoding circuit 922 is connected with the master control board 91. A special processing chip can be used instead of the separate server 921. The network control board 92 further comprises a network signal port 923 or a receiver 924. In this embodiment, the network control board 92 has the network signal port 923 and the receiver 924. The network signal port 923 is connected with a network cable. The receiver 924 is adapted to receive a wireless WiFi transmission command signal. This way can achieve a wired network control or a wireless network control. Both the network signal port 923 and the receiver 924 are connected with the separate server 921.

The control device 90 further comprises a control panel 93. The control panel 93 is exposed out of the housing 10 and connected with the master control board 91 for the user to operate the control panel 93 manually.

The work process of this embodiment is described hereinafter. After the electric fireplace is turned on, the light of the illuminating device 40 projects on the imitation charcoal 30 to form a burning effect. In the meantime, the motor 62 brings the light reflection assembly 61 to rotate. The light of the image light source 70 projects on the turning light reflection assembly 71, and then the light is reflected by the light reflection assembly 61 to the flame processing device 50 to form flames. The flames are reflected to the image screen 20 to form flame patterns.

In winter, if it is necessary to warm up the indoor in advance, the user can use the electronic apparatus to connect the network and send a control command to the control device 90. When the network control board 92 of the control device 90 receives the network control command, the network control board 92 will output a control signal to the master control board 91. The master control board 91 works each function of the electric fireplace. The heater 80 is turned on to warm up the indoor in advance, such that the user can feel warm air when he/she comes home. Through the electronic apparatus, the user can operate the electric fireplace anytime and anywhere.

The feature of the present invention is that the control device is used to receive the network control command sent from the electronic apparatus. All the heater, the illuminating device, the motor, and the image light source are connected with the control device, such that each function of the electric fireplace can be achieved by the network control. In winter, the user can turn on the heater through network control to warm up the indoor in advance, such that he/she can feel warm air indoors. It is not required to operate the operation panel on the electric fireplace. It is very convenient to operate and use the present invention.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A network control electric fireplace, comprising a housing, an image screen disposed in the housing, an imitation charcoal, an illuminating device, a flame processing device, a light reflection device, an image light source, a heater, and a control device for receiving a network control command sent from an electronic apparatus; the housing having a transparent front door at a front side thereof, the housing having an image window therein, the image screen being disposed at the image window and located behind the front door, an accommodation space being defined between the image screen and the front door; the imitation charcoal being located in the accommodation space, the illumination device being located under the imitation charcoal; the flame processing device being located behind the image screen and comprising a plate that is formed with a plurality of holes, the light reflection device being located behind the flame processing device, the light reflection device comprising a light reflection assembly and a motor, the motor bringing the light reflection assembly to rotate; the image light source being disposed under the light reflection assembly; the heater being disposed in the housing, the housing having a hot wind outlet, the heater having an air outlet communicating with the hot wind outlet of the housing; the heater, the illuminating device, the motor, and the image light source being connected with the control device, wherein the network control board comprises a separate server and a network signal amplification decoding circuit, the separate server being connected with the network signal amplification decoding circuit, the network signal amplification decoding circuit being connected with the master control board; and the network control board further comprises a network signal port for connecting a network cable and a receiver for receiving a wireless WiFi transmission command signal, the network signal port and the receiver being both connected with the separate sever.

2. The network control electric fireplace as claimed in claim 1, wherein the control device comprises a master control board and a network control board, the master control board having a heating drive circuit, a motor drive circuit, and a light source drive circuit, the heating drive circuit being connected with the heater, the motor drive circuit being connected with the motor, the light source drive circuit being connected with the illuminating device and the image light source.

3. The network control electric fireplace as claimed in claim 2, wherein the control device further comprises a control panel, and the control panel is exposed out of the housing and connected with the master control board.

4. The network control electric fireplace as claimed in claim 2, wherein the master control board and the network control board are installed at a rear interior of the housing or at an upper cover of the housing.

5. The network control electric fireplace as claimed in claim 1, wherein the electronic apparatus is one of a cell phone, a computer, and an iPad.

6. The network control electric fireplace as claimed in claim 1, wherein the motor is one of a stepper motor, a synchronous motor, and a direct current motor.

7. The network control electric fireplace as claimed in claim 1, wherein the front door is one of a glass door and a meshed door.

8. The network control electric fireplace as claimed in claim 1, wherein the illumination device is an LED (light emitting diode) illuminating device, and the image light source is an LED image light source.

* * * * *